US006438766B1

(12) United States Patent
Capdevila Arnau et al.

(10) Patent No.: US 6,438,766 B1
(45) Date of Patent: Aug. 27, 2002

(54) SWIMMING POOL BOTTOM FLUSHING DEVICE

(75) Inventors: Joan Capdevila Arnau; Armand Puiggros Roig, both of Girona (ES)

(73) Assignee: Sacopa, S.A., Sant Jaume de Llierca (Girona) (ES)

( * ) Notice: Subject to any disclaimer, the term of this patent is extended or adjusted under 35 U.S.C. 154(b) by 0 days.

(21) Appl. No.: 09/631,433

(22) Filed: Aug. 2, 2000

(30) Foreign Application Priority Data

Aug. 5, 1999 (ES) ..... 9902095 U

(51) Int. Cl.[7] ..... E04H 4/00

(52) U.S. Cl. ..... 4/490; 4/492; 239/205; 239/206; 239/394

(58) Field of Search ..... 4/490, 492, 496, 4/506, 507, 541.6; 239/587.5, 587.4, 587.1, 204, 205, 206, 394, 392, 391, 390, 261, 251, 225.1

(56) References Cited

U.S. PATENT DOCUMENTS 3,408,006 A * 10/1968 Stanwood ..... 239/66
3,702,678 A * 11/1972 Hauser ..... 239/206
4,466,142 A * 8/1984 Gould ..... 4/490
4,939,797 A * 7/1990 Goetti ..... 4/490
5,251,343 A * 10/1993 Goetti ..... 4/490
5,765,757 A * 6/1998 Rendall ..... 239/205

* cited by examiner

*Primary Examiner*—Gregory Huson
*Assistant Examiner*—Huyen Le
(74) *Attorney, Agent, or Firm*—Steinberg & Raskin, P.C.

(57) ABSTRACT

A swimming pool bottom flushing device comprising a tubular supporting arrangement attached to a pipe arranged at the bottom of a swimming pool, and a water ejector nozzle axially fitted into said supporting arrangement in a rotatable, vertically shiftable arrangement. This device is characterized in that the nozzle is formed by an open-ended tubular body provided at least with one opening in its periphery and fitted with a tubular, rotationally positionable plug peripherally provided with openings of different diameters provided to selectively face the openings of the tubular body in order to control the outflow of the water jet being ejected for the flushing of the swimming pool bottom. The top plug is selectively secured by means of a bayonet attachment into a number of positions when fitted to the tubular body of the nozzle.

6 Claims, 3 Drawing Sheets

SWIMMING POOL BOTTOM FLUSHING DEVICE

FIELD OF THE INVENTION

The present invention relates to a swimming pool bottom flushing device.

BACKGROUND OF THE INVENTION

This device is of the type comprising a tubular supporting arrangement glued to a PVC pipe arranged at the swimming pool bottom, and a nozzle axially fitted into said supporting arrangement in a freely rotatable, vertically shiftable arrangement, said nozzle laterally having at least one orifice through which water is ejected to flush the swimming pool bottom, means being provided between the supporting arrangement and the nozzle to determine the intermittent, partial rotation of the nozzle.

OBJECTS AND SUMMARY OF THE INVENTION

This invention has as its object a device whose nozzle comprises a fitted-in upper tubular plug arranged as per a rotationally positionable arrangement and laterally having openings of different diameters provided to selectively face at least one opening of the nozzle's tubular body in order to control the flow rate and pressure of the water jet ejected for the flushing of the swimming pool bottom.

The construction of the tubular body of said nozzle allows it to indifferently fit in, through the use of corresponding means, with a spring or a weight provided to urge said tubular body downwards in its vertically shifting motion.

Said tubular body is inserted into a bushing fitted into the tubular supporting arrangement supporting the nozzle, said tubular body is provided on its periphery with lugs extending between alternate projections projecting as per an inclined plane from the inner periphery of said bushing in order to thus obtain its intermittent rotation as it shifts vertically.

A safety element has been provided in order to disengageably engage the top plug with the tubular body of the nozzle.

These and other characteristics will be best made apparent by the following detailed description whose understanding will be made easier by the accompanying two sheets of drawings showing a practical embodiment cited only by way of an example not limiting the scope of the present invention.

BREIF DESCRIPTION OF THE DRAWINGS

DETAILED DESCRIPTION OF THE INVENTION

Figure 1:
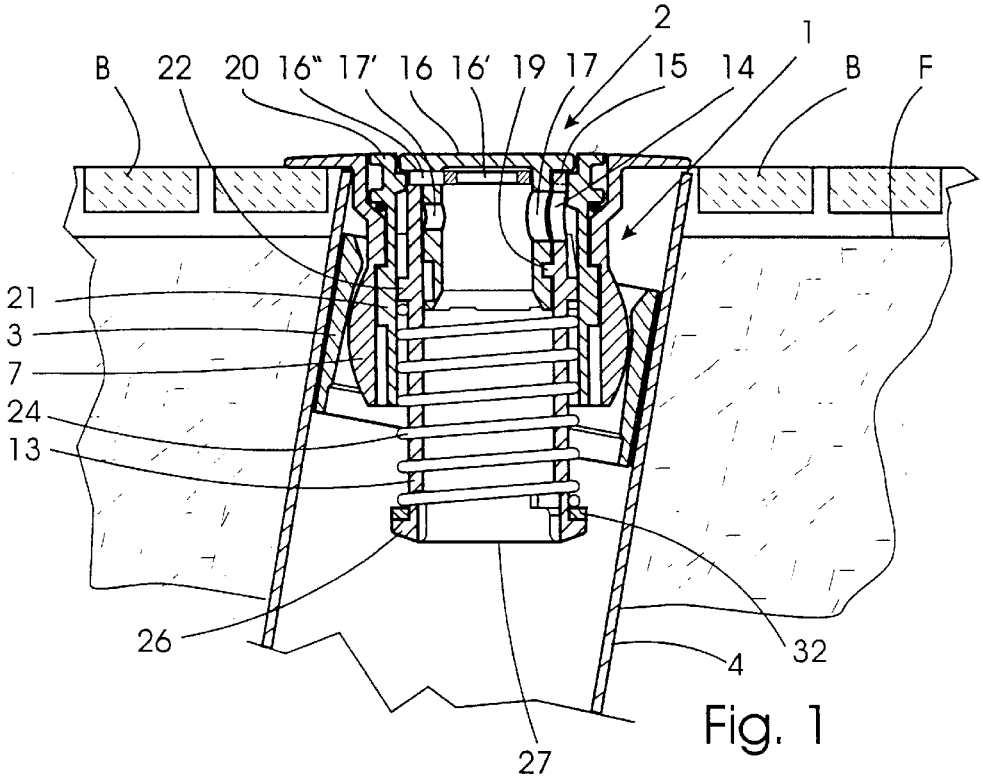
FIGS. 1 and 2 are sectional elevations of the assembly forming this device equipped with a spring or with a weight, respectively.

According to the drawings the swimming pool bottom flushing device comprises a tubular supporting arrangement 1 attached to the bottom F of a swimming pool, and a nozzle 2 with at least one opening 14 in the upper region of its periphery, said nozzle being fitted at its open top 15 with a tubular, rotationally positionable plug 16 peripherally provided with two openings 17 and 17' of different diameters provided to selectively face the opening 14 of a tubular body 13 in order to control the outflow of the water jet ejected during the flushing of the swimming pool bottom F, this latter being in this case flagged with stoneware tiles B or the like.

Figure 2:
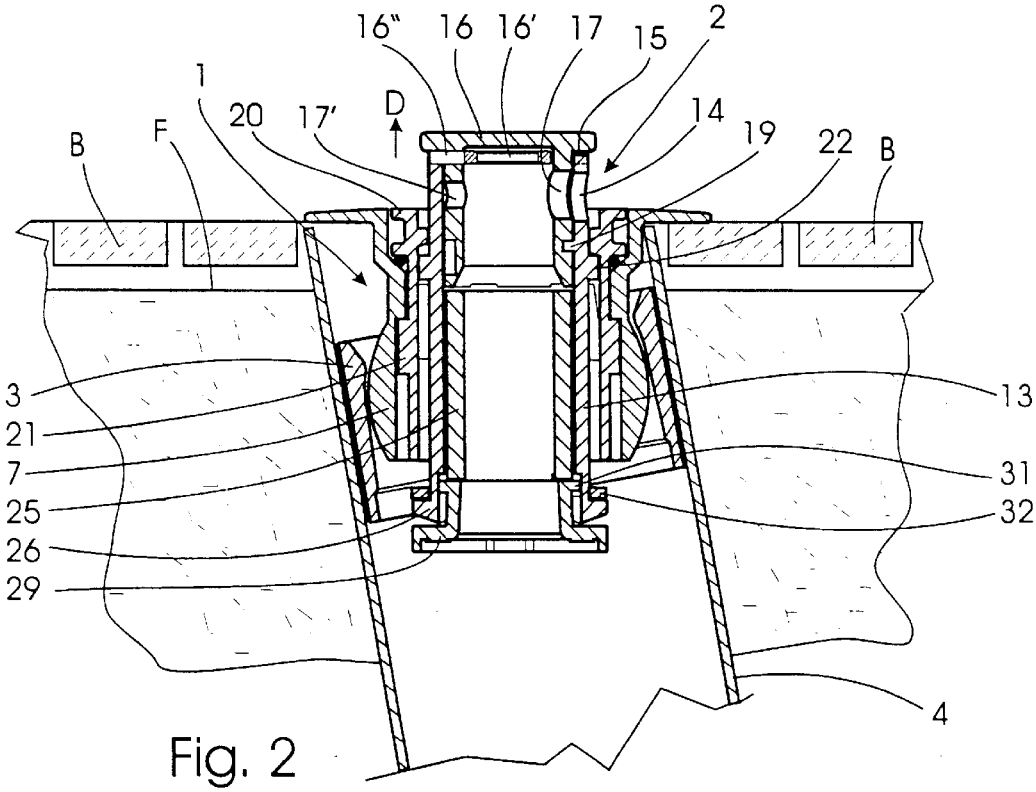

The selective fitting of plug 16 into tubular body 13 is obtained and secured by means of several bayonet locks 18 (FIG. 3), the inner periphery of said tubular body 13 for such a purpose having the pertinent lugs 19 (FIGS. 1 and 2).

Tubular body 13 is freely fitted into a bushing 20 by bayonet couplings means having four equispaced lugs 21 extending into the tubular supporting arrangement 1 provided to support the nozzle, said tubular body on its outer periphery also comprising four equispaced lugs 22 extending between alternate projections 23 projecting as per an inclined plane (FIG. 5) from the inner periphery of said bushing in order to thus obtain its intermittent rotation as it is vertically shifted upwards as per arrow D (FIG. 2) by virtue of the water pressure acting thereon.

Figure 3:
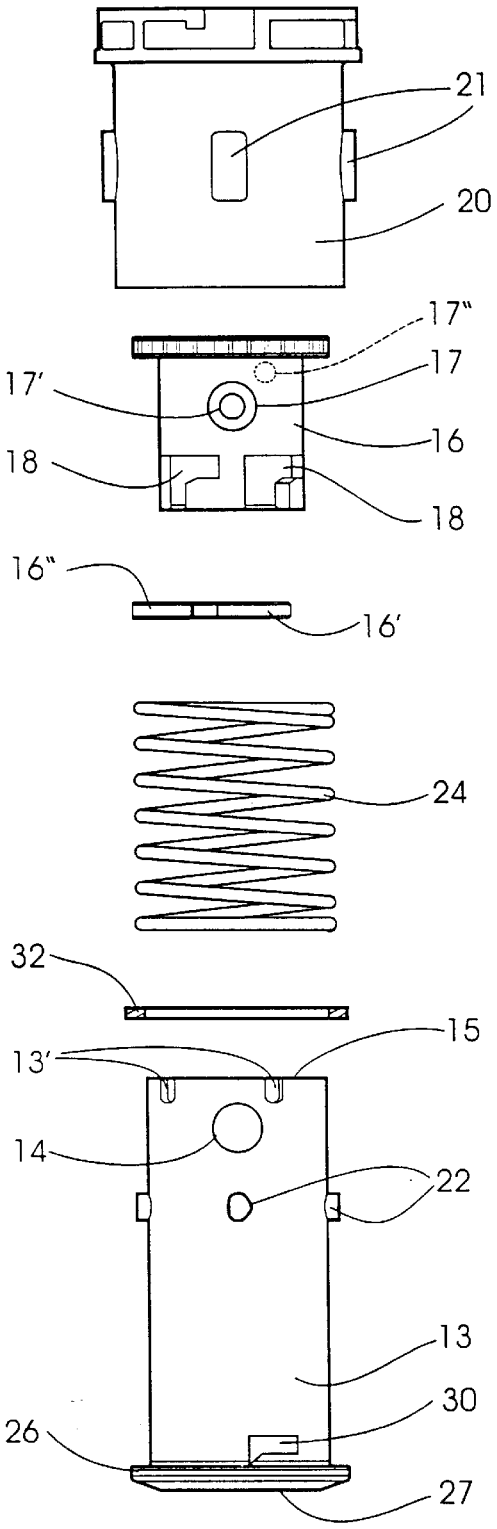
FIG. 3 is an exploded elevational view the components of the spring-biased nozzle shown in FIG. 1.
Figure 4:
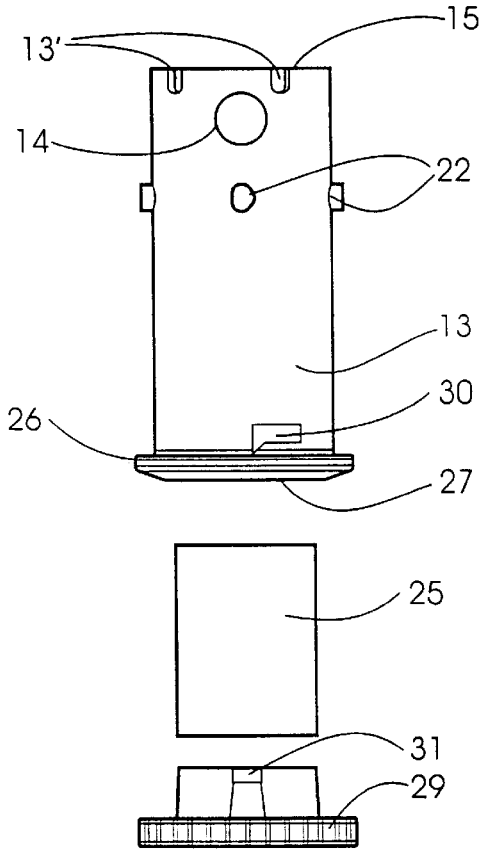
FIG. 4 is an exploded elevational view of the tubular body of the nozzle provided to be equipped with a weight.

When the water pressure lessens the downward vertical shifting motion of tubular body 13 is indifferently achieved by means of a spring 24 (FIGS. 1 and 3) or by means of a weight 25 (FIGS. 2 and 4).

Figure 5:
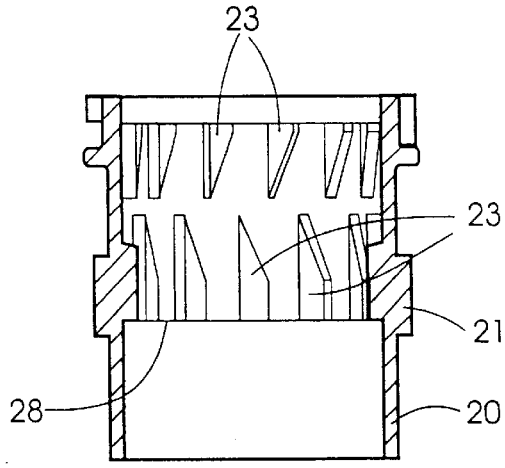
FIG. 5 is a sectional elevation view of the bushing provided to be freely fitted around the tubular body of the nozzle.
Figure 6:
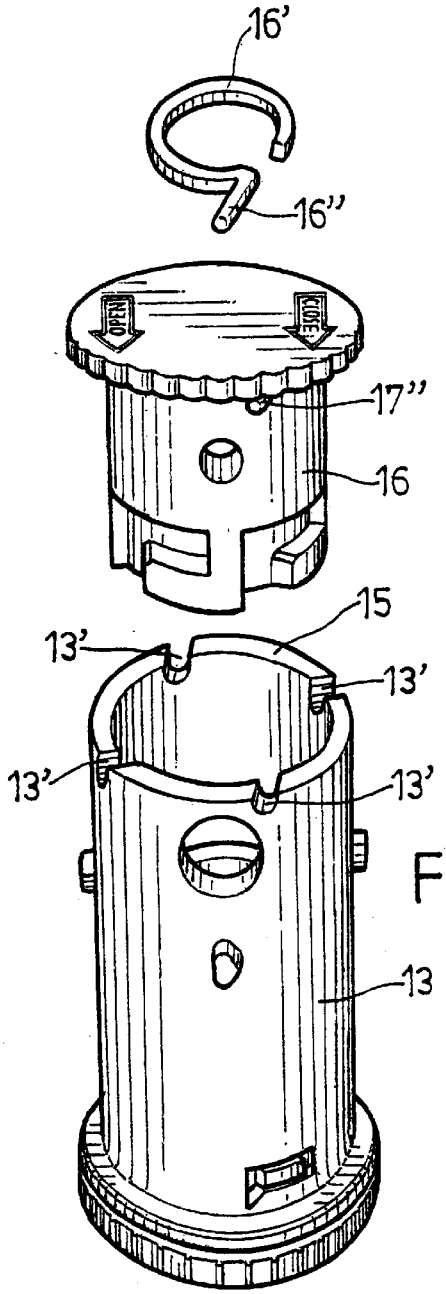
FIG. 6 is a perspective view of the tubular body of the nozzle and the safety element.
Figure 7:
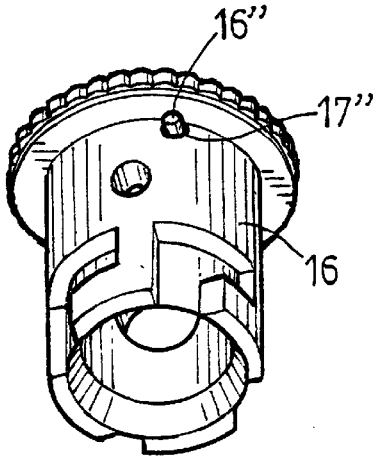
FIG. 7 is a perspective view of the tubular body of the nozzle with the safety element inserted therein.
Figure 8:
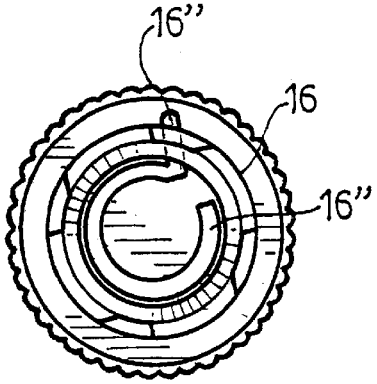
FIG. 8 is a bottom plan view of the tubular body of the nozzle.

Spring 24 is structured and arranged around said tubular body and between a peripheral flange 26, located at the open bottom 27 of said body, and a step 28 located on the inner periphery of bushing 20 (FIG. 5).

Weight 25 is tubular and is inserted into tubular body 13 thereby being inferiorly retained by means of a ring 29 fitted through bayonet coupling at 30 to the open bottom 27 of said tubular body, said ring for such a purpose having two opposed lugs 31 (FIG. 4).

A seal 32 is arranged on top of flange 26 of tubular body 13.

In order to prevent top plug 16 from being accidentally disengaged from the nozzle's tubular body 13 (said disengagement possibly causing components of the nozzle to fall into pipe 4) a safety element has been provided to engage said plug with said body, said safety element comprising of a resilient, split annular piece 16' tangentially extending into a stub 16". This annular piece is arranged inside plug 16 next to its top bottom thereby passing stub 16" through a lateral orifice 17" of said plug, said stub thus projecting from said orifice to thereby fit into one of the four notches 13' provided at the open top of tubular body 13 (FIG. 3). In order to unlock the safety element the free end of stub 16" is pushed, thereby causing said stub to be shifted into the inside of plug 16 due to the resilient yielding on the part of annular piece 16, thus allowing one to actuate said plug in order to change its position by means of its bayonet locks.

In the case of said pipe 4 being fitted with this swimming pool bottom flushing device being arranged in an inclined arrangement with respect to said bottom, the tubular supporting arrangement 1 will comprise a socket 3 and a bushing 7 forming a ball-and-socket joint in order to obtain the upward shifting motion of the nozzle's tubular body 13 at right angles with respect to the swimming pool bottom.

We claim:

1. A swimming pool bottom flushing device comprising:

a tubular supporting arrangement attached to a pipe arranged at the swimming pool bottom; and a water ejector nozzle axially fitted into said supporting arrangement in a freely rotatable, vertically shiftable arrangement; wherein the nozzle is formed by an open-ended tubular body provided with at least one opening in its periphery and fitted at its open top with a tubular, rotationally positionable plug peripherally provided with openings of different diameters provided to selectively face the opening of the tubular body in order to control the outflow of the water jet being ejected for the flushing of the swimming pool bottom;

wherein the tubular body is freely inserted into a bushing fitted into the tubular supporting arrangement supporting the nozzle, said tubular body on its periphery having lugs extending between alternate projections projecting as per an inclined plane from the inner periphery of said bushing in order to obtain its intermittent rotation as it shifts vertically, this tubular body comprising means urging it towards its lowered position; and wherein the means urging the tubular body towards its lowered position include a weight inserted into said tubular body and inferiorly retained by means of a ring fitted through a bayonet coupling to the open bottom of said tubular body.

2. A device as in claim 1, wherein the means urging the tubular body towards its lowered position include a spring structured and arranged around said body interposed between a peripheral flange of the open bottom of said body and a step of the inner periphery of the bushing housing said tubular body.

3. A swimming pool bottom flushing device comprising:

a tubular supporting arrangement attached to a pipe arranged at the swimming pool bottom; and a water ejector nozzle axially fitted into said supporting arrangement in a freely rotatable, vertically shiftable arrangement; wherein the nozzle is formed by an open-ended tubular body provided with at least one opening in its periphery and fitted at its open top with a tubular, rotationally positionable plug peripherally provided with openings of different diameters provided to selectively face the openings of the tubular body in order to control the outflow of the water jet being ejected for the flushing of the swimming pool bottom; and a safety element provided to disengageably engage the top plug with the tubular body of the nozzle, said safety element comprising a resilient, annular piece tangentially extending into a stub, said annular piece being arranged inside the top plug thereby passing the stub through a lateral orifice of said plug, said stub thus projecting from said orifice to thereby fit into one of a plurality of notches provided at the open top of the nozzle's tubular body.

4. A swimming pool bottom flushing device comprising:

a tubular support body structured and arranged for attachment to a pipe arranged at the bottom of a swimming pool; and a water ejector nozzle adapted and arranged to be axially fitted into said tubular support body in a freely rotatable, vertically shiftable arrangement;

wherein said nozzle comprises an open-ended tubular body provided with at least one opening in its periphery and fitted at its open top with a tubular, rotationally positionable plug provided with a plurality of openings of different diameters along its periphery to selectively engage and radially align with said opening of said tubular body, thereby controlling the outflow of a water jet being ejected from said nozzle for the flushing of the swimming pool bottom depending on the selected alignment of said holes;

a bushing structured and arranged to fit within said tubular body supporting arrangement, wherein said nozzle is supported by said bushing within said tubular body;

a plurality of lugs formed along the periphery of said tubular body and extending radially outward from said tubular body;

a plurality of projections formed along the periphery of said bushing and extending radially inward of said bushing in an inclined plane, adapted and arranged for engaging said lugs in order to obtain intermittent rotation of said tubular body as it shifts vertically within said device; and means for urging said tubular body towards a lowered position within said device;

wherein said means urging said tubular body towards its lowered position comprise a weight structured and arranged to be inserted into said tubular body and inferiorly held therein by retaining means comprising a ring structured and arranged to be fitted through a bayonet coupling to an open bottom of said tubular body.

5. A swimming pool bottom flushing device comprising:

a tubular support body structured and arranged for attachment to a pipe arranged at the bottom of a swimming pool; and a water ejector nozzle adapted and arranged to be axially fitted into said tubular support body in a freely rotatable, vertically shiftable arrangement;

wherein said nozzle comprises an open-ended tubular body provided with at least one opening in its periphery and fitted at its open top with a tubular, rotationally positionable plug provided with a plurality of openings of different diameters along its periphery to selectively engage and radially align with said opening of said tubular body, thereby controlling the outflow of a water jet being ejected from said nozzle for the flushing of the swimming pool bottom depending on the selected alignment of said holes;

a bushing structured and arranged to fit within said tubular body supporting arrangement, wherein said nozzle is supported by said bushing within said tubular body;

a plurality of lugs formed along the periphery of said tubular body and extending radially outward from said tubular body;

a plurality of projections formed along the periphery of said bushing and extending radially inward of said bushing in an inclined plane, adapted and arranged for engaging said lugs in order to obtain intermittent rotation of said tubular body as it shifts vertically within said device; and means for urging said tubular body towards a lowered position within said device; and a safety element provided to disengageably engage said top plug with said tubular body of said nozzle, said safety element comprising a resilient, annular member tangentially extending and terminating in a stub, said annular member being structured and arranged inside said top plug thereby passing said stub through a lateral orifice formed in said plug, said stub thus projecting from said orifice to thereby fit into one of a plurality of notches formed at said open top of said nozzle.

6. A device as in claim 5, wherein said means for urging said tubular body towards its lowered position comprise:

a spring structured and arranged around said tubular body and interposed between a peripheral flange at an open bottom of said tubular body and a step formed at the inner periphery of said bushing housed within said tubular body.

* * * * *